United States Patent [19]

Catalano

[11] Patent Number: 4,824,114

[45] Date of Patent: Apr. 25, 1989

[54] GOLF PUTTER WITH SLOPE INDICATING MEANS THEREIN

[76] Inventor: Guy G. Catalano, 9522 Telephone Rd., #108, Houston, Tex. 77075

[21] Appl. No.: 100,313

[22] Filed: Sep. 23, 1987

[51] Int. Cl.[4] ..... A63B 3/00; A63B 69/36

[52] U.S. Cl. ..... 273/162 B; 273/162 R; 273/32 H; 273/183 E; 33/334; 33/398

[58] Field of Search ..... 273/162 B, 163 R, 162 R, 273/32 H, 183 E; 7/164; 33/334, 391, 398

[56] References Cited

U.S. PATENT DOCUMENTS

| | | | |
|---|---|---|---|
| 208,654 | 10/1878 | Waldman et al. | 33/334 X |
| 441,772 | 12/1890 | Miller | 33/391 |
| 1,602,276 | 10/1926 | Lutz | 33/391 |
| 2,919,922 | 1/1960 | Skelly | 273/163 R |
| 2,976,046 | 3/1961 | McCullough | 273/162 B |
| 2,995,375 | 8/1961 | Bukovey | 273/162 B |
| 3,293,755 | 12/1966 | Cronewell | 273/163 R X |
| 3,306,618 | 2/1967 | Liljequest | 273/163 R |
| 3,429,576 | 2/1969 | Ikeeda | 273/162 B |
| 3,700,244 | 10/1972 | Liotta | 273/183 D |
| 3,885,306 | 5/1975 | Herman | 33/334 X |
| 3,979,125 | 9/1976 | Lanicellotti | 273/186 A |
| 4,082,286 | 4/1978 | LeBrecht | 273/162 B |
| 4,194,739 | 3/1980 | Thompson | 273/162 B X |
| 4,482,155 | 11/1984 | Higley | 273/162 B |
| 4,581,782 | 4/1986 | Riley | 33/334 X |

*Primary Examiner*—Samuel Scott

*Assistant Examiner*—Carl D. Price

*Attorney, Agent, or Firm*—Neal J. Mosely

[57] ABSTRACT

A golf club putter is disclosed for use on a golf green for judging the desired path to the cup. The putter comprises a shaft with a putter head secured on one end thereof. The putter has a vertically oriented striking surface for striking a golf ball on swinging movement of the club and a second surface positioned at substantially a right angle to the striking first surface. Level means is supported in the second or right angle surface for indicating the desired angle at which the putter striking surface should strike the ball and the desired curvature of the path of the ball to the cup. The level means comprises a pendulum, recessed in the second, right angle surface, operating as a plumb bob to determine the angle from the horizontal of the putting green. The level means comprises a thin, flat disc-shaped housing mounted in a recess in the second, right angle surface of the putter having a circular rear wall, a circular front wall and a cylindrical side wall. The disc shaped housing has a pivot on which the pendulum is supported and hangs centrally of the housing. The circular front wall is transparent with an opaque coating having a central clear area defining a circular central window through which the pendulum is viewed. A circular indicia on the pendulum of the same size as the window is viewable against the circular edge of said window to indicate the angle and ball path.

8 Claims, 4 Drawing Sheets

GOLF PUTTER WITH SLOPE INDICATING MEANS THEREIN

BACKGROUND OF THE INVENTION

1. FIELD OF THE INVENTION

This invention relates to new and useful improvements in golf putters and more particularly to a putter having a level indicating means supported therein operable to indicate the level of the green and the desired path of the ball to the cup.

2. BRIEF DESCRIPTION OF THE PRIOR ART

The prior art includes a number of patents showing various leveling devices for golf putters:

Skelly U.S. Pat. No. 2,919,922 discloses a golf putter with two putting faces and a spirit level in the upper face thereof.

McCullough U.S. Pat. No. 2,976,046 discloses a golf putter with two putting faces and a spirit level in the upper face thereof with a resilient plug securing the level in place.

Bukovey U.S. Pat. No. 2,995,375 discloses a golf putter with two putting faces and a spirit level in an upper edge or corner.

Liljequist U.S. Pat. No. 3,306,618 discloses a golf putter with a spirit level in the upper face thereof and indicia across the face of the level.

Ikeda U.S. Pat. No. 3,429,576 discloses a golf putter with a spirit level in the upper face thereof and a weight in the head of the putter.

Liotta U.S. Pat. No. 3,700,244 discloses a golf putter with spherical head and a mirror face.

Lancellotti U.S. Pat. No. 3,979,125 discloses a golf putter with a spirit level in the upper face thereof and a ball arrangement for indicating the direction for putting.

Le Breche U.S. Pat. No. 4,082,286 discloses a golf putter with a spirit level in the upper face thereof and indicia for assistance in putting.

Thompson U.S. Pat. No. 4,194,739 discloses a golf putter With an adjustable head.

Higley U.S. Pat. No. 4,482,155 discloses a golf putter with a spirit level in the upper end of the handle.

SUMMARY OF THE INVENTION

One of the objects of this invention is to provide a new and improved golf putter with a level indicating device therein.

Another object of this invention is to provide a new and improved golf putter with a level indicating device therein which indicates both the level or slope of the green and the desired path for the ball being putted.

Another object of this invention is to provide a new and improved golf putter with a level indicating device which will indicate which direction the ball will break.

Another object of this invention is to provide a new and improved golf putter with a level indicating device by which the slope of the green and the desired path for the ball is represented in color to be clearly visible and easily understood.

Another object of this invention is to provide a new and improved golf putter with a level indicating mechanism utilizing the principle of a plumb bob to indicate the slope of the green relative to a horizontal plane.

A further object of this invention is to provide a new and improved golf putter with a level indicating device therein which is simple in construction, economical to manufacture, and rugged and durable in use.

Other objects of this invention will become apparent from time to time throughout the specification and claims as hereinafter related.

The foregoing objects and other objects of the invention are accomplished by a golf club putter for use on a golf green for judging the desired path to the cup. The putter comprises a shaft with a putter head secured on one end thereof. The putter has a vertically oriented striking surface for striking a golf ball on swinging movement of the club and a second surface positioned at substantially a right angle to the striking first surface. Level means is supported in the second or right angle surface for indicating the desired angle at which the putter striking surface should strike the ball and the desired curvature of the path of the ball to the cup. The level means comprises a pendulum, recessed in the second, right angle surface, operating as a plumb bob to determine the angle from the horizontal of the putting green. The level means comprises a thin, flat disc-shaped housing mounted in a recess in the second, right angle surface of the putter having a circular rear wall, a circular front wall and a cylindrical side wall. The disc shaped housing has a pivot on which the pendulum is supported and hangs centrally of the housing. The circular front wall is transparent with an opaque coating having a central clear area defining a circular central window through which the pendulum is viewed.

DESCRIPTION OF A PREFERRED EMBODIMENT

Figure 1:
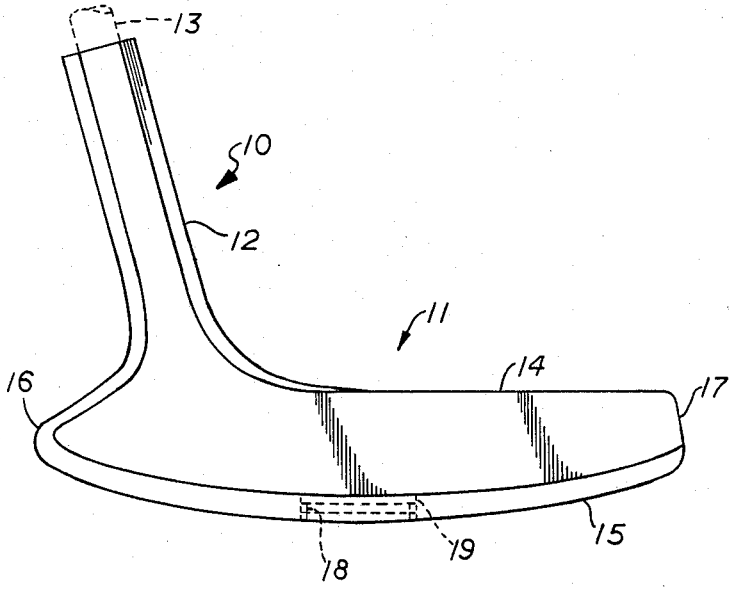
FIG. 1 is a view in side elevation of a golf putter illustrating a preferred embodiment of the invention.
Figure 2:
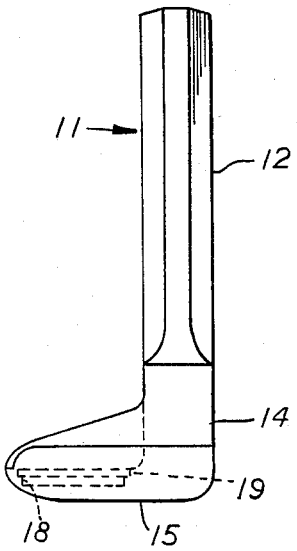
FIG. 2 is an end elevation of the putter of FIG. 1 and relating the leveling indicator to the striking face of the putter.
Figure 3:
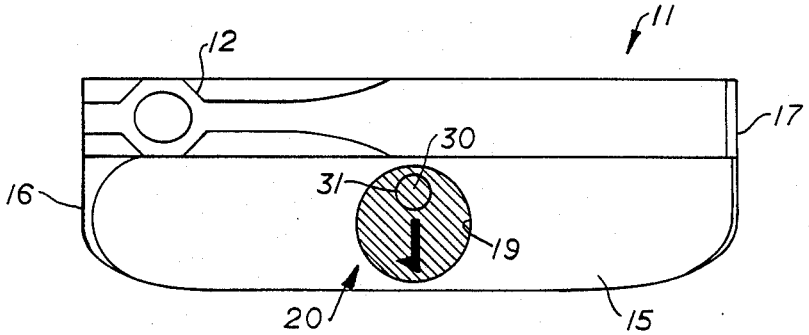
FIG. 3 is a top plan view of the putter of FIG. 1 showing the location of the leveling indicator.
Figure 4:
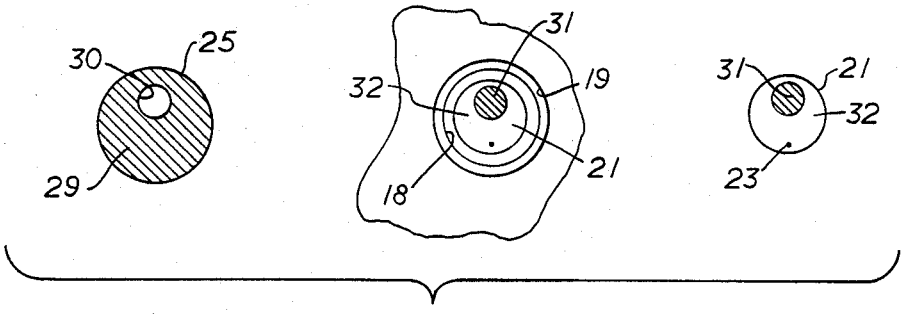
FIG. 4 is an exploded view of the components comprising the leveling indicator.
Figure 5:
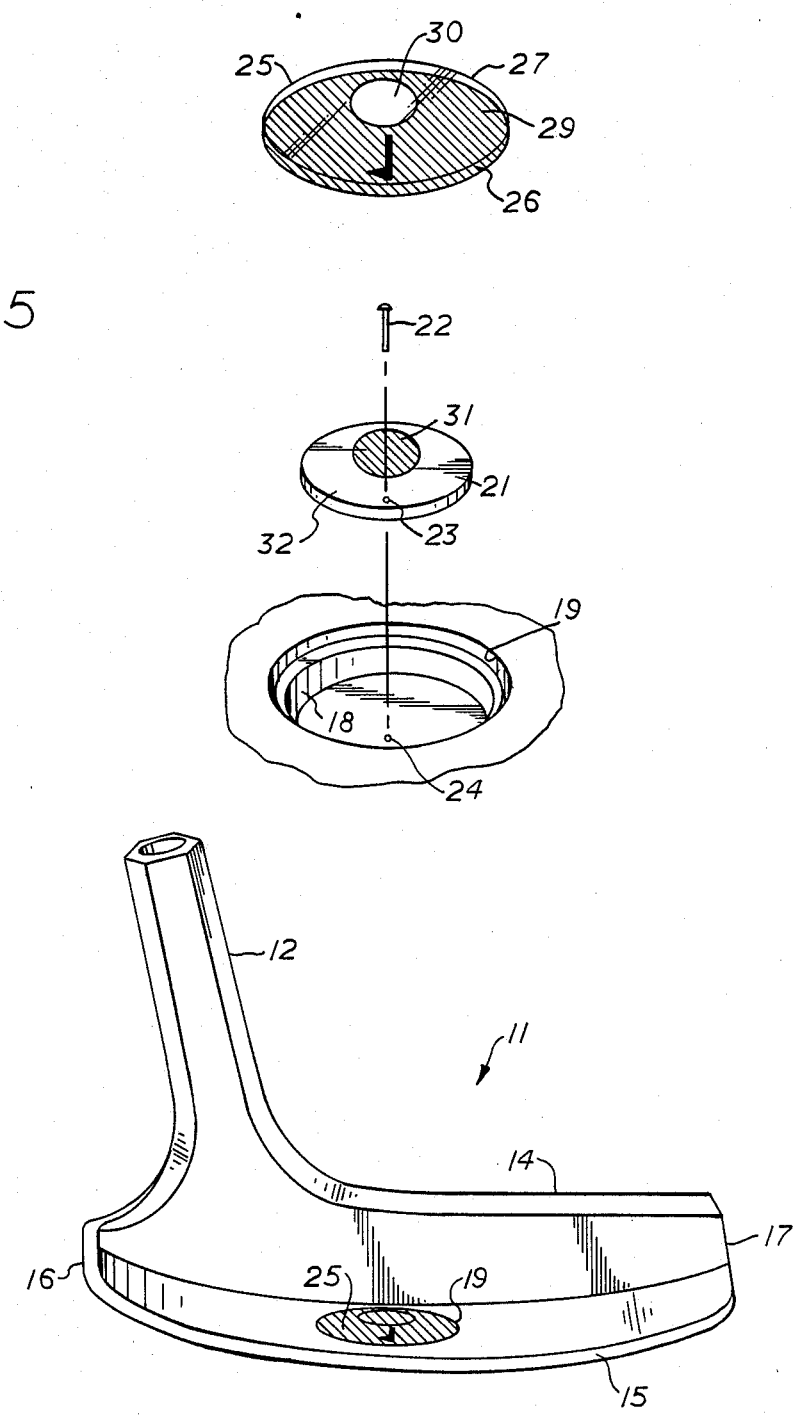
FIG. 5 is an exploded view of the leveling indicator and the putter head.

Referring now to the drawings by numerals of reference, there is shown a preferred golf club putter 10 for use on a golf green for judging the desired path to the cup. The putter 10 comprises ball engaging portion, or head 11, located at its lower end having a hosel portion 12 extending upwardly therefrom into which the club shaft 13 is secured. The putter head 11 has a substantially flat striking surface or face 14 disposed in a generally vertical plane for striking a golf ball on swinging movement of the club and a bottom surface or sole 15 positioned at substantially a right angle to the striking face. The inward end of the head 11 (nearest the user) and the outer end are conventionally known as the heel 16 and toe 17 portions respectively.

A vertical, shallow cylindrical recess 18 extends a short distance from the top surface of the sole 15 generally centrally and intermediate the heel 16 and toe 17 portions and the recess 18 is provided with a shallow counterbore 19.

A level assembly 20 is mounted within the recess 18 and counterbore 19. The level assembly 20 comprises a flat, pendulum 21 pivotally mounted at the bottom of the recess 18 by a pivot pin 22 received through a hole 23 at its top end and the end of which is press fitted into a small hole 24 in the bottom surface of the recess. A thin, flat, disc-shaped housing or lens 25 having a circular bottom or rear wall 26, a circular top or front wall 27 and a cylindrical side wall 28 is secured within the counterbore 19. The preferred lens 25 is formed of a durable transparent plastic material such as polycarbonate. The pendulum 21 is supported and positioned so that the pendulum hangs centrally beneath the lens 25 and acts as a plumb bob. The pendulum 25 is sized and shaped sufficient to permit a substantial amount of pivotal movement before stopping against the wall of the recess 18.

The circular bottom or rear wall 26 of the lens 25 is coated to render it opaque such as by silk screening or other suitable means. The opaque coating 29 has a clear transparent area defining a circular central window 30 through which the pendulum 21 is viewed.

The top surface of the pendulum 21 is provided with a circular colored area 31 of about the same size as the circular window 30 of the lens and substantially fills the window when the pendulum is hanging vertically in relation to the striking surface or face 14. The circular area 31 on the pendulum 21 is of a color to contrast with the remaining top surface or background color 32 of the pendulum, and may be the same color as the opaque color of the lens. The background color 32 of the pendulum is of a different color than the opaque color of the lens whereby the background surrounding the circular area on the pendulum is clearly viewable against the circular edge of the window 30.

The circular lens window 30 and circular area 31 on the pendulum 21 cooperate in a manner to indicate the angle of the green relative to horizontal and the path the ball must travel to hit the cup. For example, assume that the opaque color of the lens 25 is green with a clear window 30, the circular area 31 of the pendulum is green and the pendulum background 32 surrounding the circular area is red. When the pendulum 21 is vertical or level, the green circular area 31 of the pendulum fills the circular window 30 and only green color is visible across the lens surface.

If the pendulum is to the right of vertical the circular area 31 does not completely fill the window 30 and an arcuate portion of the red background color 32 to the left side of the circular area is visible in the window 30. If the pendulum 21 is to the left of vertical the circular area 31 does not completely fill the window and an arcuate portion of the red background color 32 to the right side of the circular area 31 is visible in the window 30. The arcuate red crescent 32 indicates the desired angle at which the club face 14 should strike the ball and the desired curvature of the path of the ball to the cup.

OPERATION

Having thus described the major components of a preferred embodiment of the putter, their operation will be readily understood with particular reference to FIGS. 6 through 9. Again, assume that the opaque color of the lens 25 is green with a clear window 30, the circular area 31 of the pendulum is green and the pendulum background 32 surrounding the circular area is red.

When the golfer is on the green and preparing to make the putt, the golfer places the putter 10 on the surface of the green with the handle near the ball and the face 14 of the putter head resting flush on the surface between the ball and the cup. The shaft 13 lies on an imaginary straight line from the ball to the cup. The golfer then looks along the line of the shaft at the top of the putter head or sole portion to view the level indicator.

Figure 7:
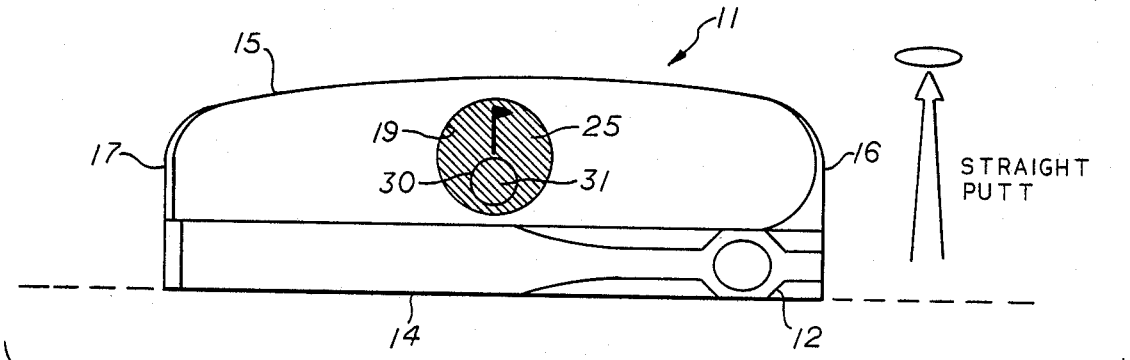

If the slope of the green is fairly flat, the pendulum will be suspended vertically and the green circular area 31 of the pendulum will fill the circular window 30 and only green color will be visible across the lens surface as illustrated in FIG. 7. This will indicate that the slope is fairly flat and that the ball should be hit straight toward the cup.

Figure 6:
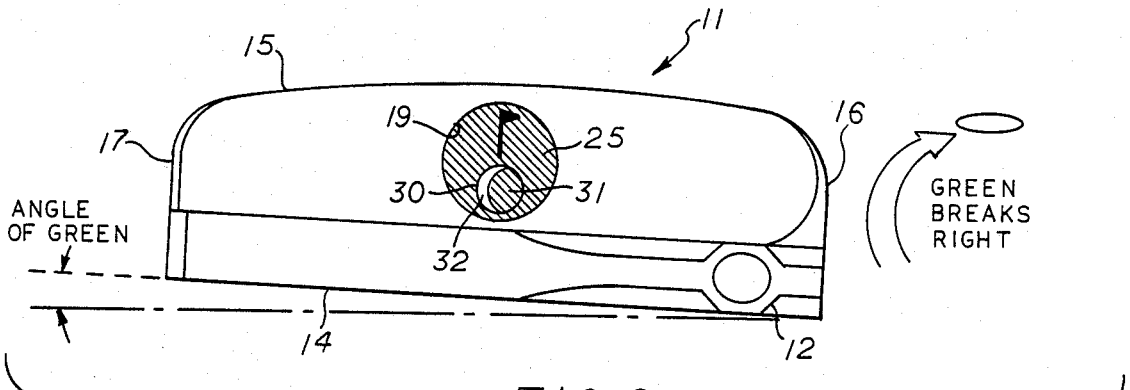
FIGS. 6, 7 and 8 are elevation views illustrating the use of the putter and looking at the top of the sole portion of the putter head when placed on the surface of the putting green.

If the pendulum is to the right of vertical, the circular area 31 will not completely fill the window 30 and an arcuate crescent of the red background color 32 will appear at the left side of the window 30 as illustrated in FIG. 6. This will indicate that the green is sloping downward to the right and that the ball will break to the right. The red crescent also indicates that the golfer should putt to the left so that the ball will follow a path resembling the curvature of the crescent.

Figure 8:
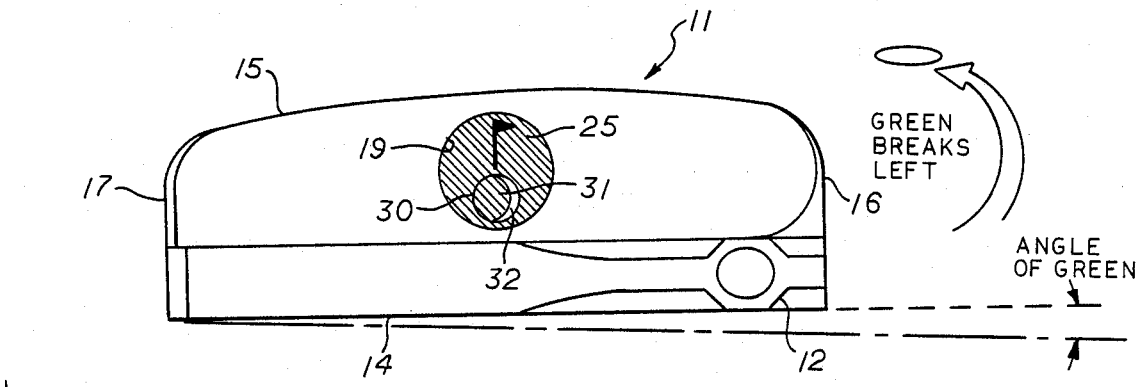
Figure 9:
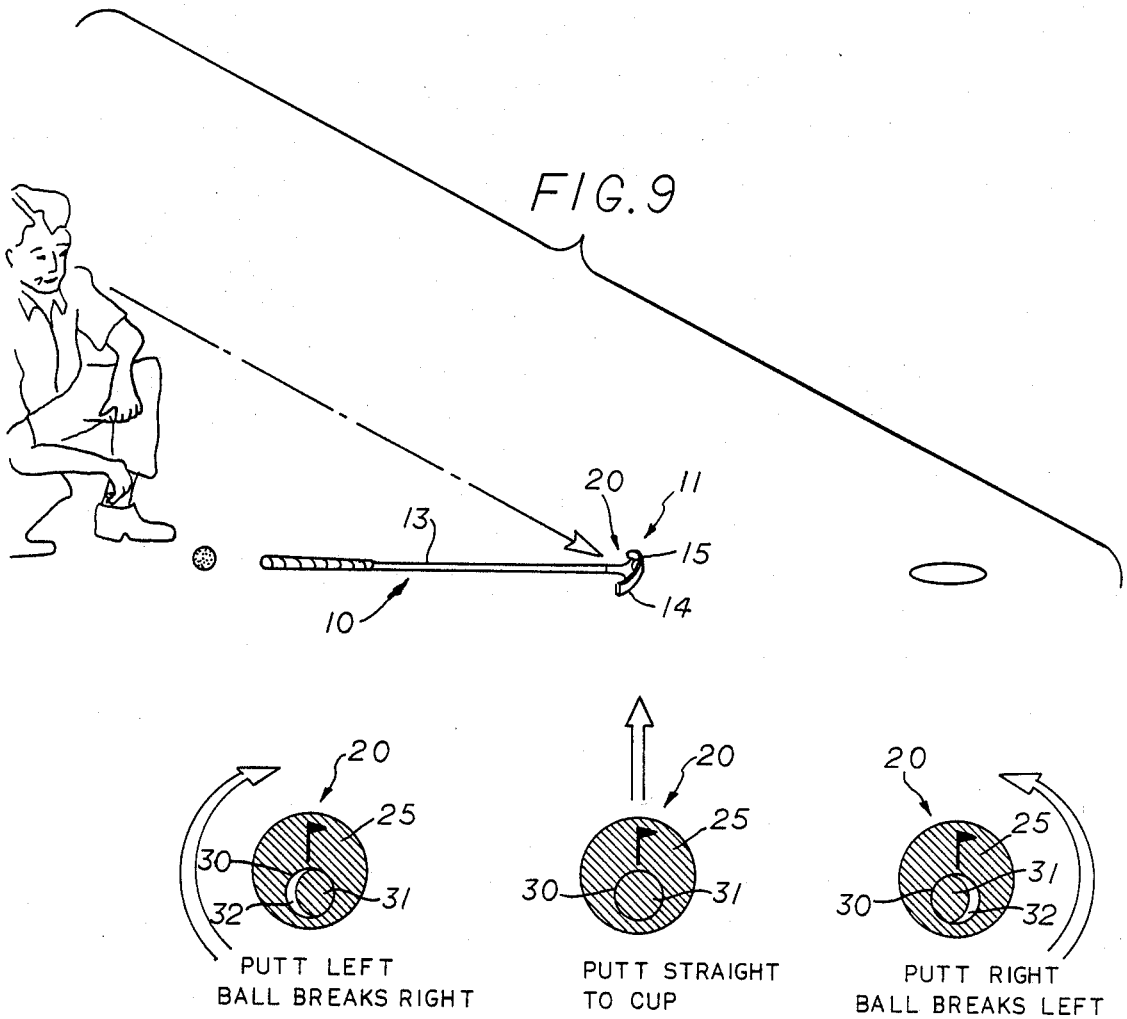
FIG. 9 is a pictorial schematic illustration showing the putter in use.

If the pendulum is to the left of vertical, the circular area 31 will not completely fill the window 30 and an arcuate crescent of the red background color 32 will appear at the right side of the window 30 as illustrated in FIG. 8. This will indicate that the green is sloping downward to the left and that the ball will break to the left. The red crescent 32 also indicates that the golfer should putt to the right so that the ball will follow a path resembling the curvature of the crescent.

While this invention has been described fully and completely with special emphasis upon a preferred embodiment, it should be understood that within the scope of the appended claims, the invention may be practiced otherwise than as specifically described herein.

I claim:

1. A golf club putter for use on a golf green for judging a desired curvature of a path of a ball from a point on the golf green to a cup thereon, said putter comprising a shaft having a head-supporting end, a putter head secured on the head-supporting end of said shaft, said putter having a first surface oriented for striking a golf ball on swinging movement of said club, and a second surface positioned at substantially a right angle to said first surface, direction indicating means supported in said second surface including indicia adapted, when said club is positioned with said first surface flat on said putting green, to indicate a desired angle at which said first surface should strike a ball and the desired curvature of the path of travel of the ball to the cup, and said direction indicating means comprising a pendulum operating as a plumb bob to determine the angular relationship of said putting green with respect to a horizontal plane, said pendulum further including a first portion of said indicia, said first indicia portion cooperating with a second, stationary portion of said indicia for indicating the desired angle at which said first surface should strike the ball and the desired cuvature of the path of the ball to the cup.

2. A golf club putter according to claim 1 in which said pendulum is recessed in said second surface.

3. A golf club putter according to claim 2 in which said second surface has a shallow cylindrical recess therein, and said recess having a pivot on which said pendulum is supported and positioned so that said pendulum hangs centrally of said recess.

4. A golf club putter according to claim 2 in which said second surface has a shallow cylindrical recess therein, and said recess having a pivot on which said pendulum is supported and positioned so that said pendulum hangs centrally of said recess, and said pendulum is shaped to permit a substantial amount of pivotal movement before stopping against the wall of said recess.

5. A golf club putter according to claim 2 in which said second surface has a shallow cylindrical recess therein, and said recess having a pivot on which said pendulum is supported and positioned so that said pendulum hangs centrally of said recess, and said pendulum is shaped to permit a substantial amount of pivotal movement before stopping against the wall of said recess, said indicator means and indicia including a window through which said pendulum is viewed, and said pendulum being viewable against the edges of said window to indicate said angle and ball path.

6. A golf club putter according to claim 2 in which said second surface has a shallow cylindrical recess therein, and said recess having a pivot on which said pendulum is supported and positioned so that said pendulum hangs centrally of said recess, and said pendulum is shaped to permit a substantial amount of pivotal movement before stopping against the wall of said recess, said indicator means and indicia including a circular window through which said pendulum is viewed, and a circular indicia on said pendulum viewable against the circular edge of said window to indicate said angle and ball path.

7. A golf club putter according to claim 2 in which said second surface has a shallow cylindrical recess therein, and said recess having a pivot on which said pendulum is supported and positioned so that said pendulum hangs centrally of said recess, and said pendulum is shaped to permit a substantial amount of pivotal movement before stopping against the wall of said recess, said indicator means and indicia including a circular window through which said pendulum is viewed, and a circular indicia on said pendulum of the same size as said window and filling said window when said pendulum is hanging vertically in relation to said first, striking surface, said circular indicia being viewable against the circular edge of said window to indicate said angle and ball path.

8. A golf club putter according to claim 2 in which said second surface has a shallow cylindrical recess therein, and said direction indicating means includes a thin, flat, disc-shaped housing mounted in said recess, said disc shaped housing having a circular rear wall, a circular front wall and a cylindrical side wall, said circular front wall being transparent, said disc shaped housing having a pivot on which said pendulum is supported and positioned so that said pendulum hangs centrally of said housing, and said transparent front wall having an opaque coating with a central clear area defining a circular central window through which said pendulum is viewed, and a circular indicia on said pendulum of the same size as said window and filling said window when said pendulum is hanging vertically in relation to said first, striking surface, said circular indicia being viewable against the circular edge of said window to indicate said angle and ball path.

* * * * *